US005564386A

United States Patent [19]

Korte et al.

[11] Patent Number: 5,564,386

[45] Date of Patent: Oct. 15, 1996

[54] MOTORBRAKE FOR A DIESEL ENGINE

[75] Inventors: Magnus Korte, Leonberg; Emil Bäuerle, Esslingen; Klaus-Dieter Holloh, Kernen; Erwin Schmidt, Baltmannsweiler; Siegfried Lamsbach, Stuttgart; Eberhard Schneider, Waiblingen, all of Germany

[73] Assignee: Mercedes Benz A.G., Stuttgart, Germany

[21] Appl. No.: 524,901

[22] Filed: Sep. 7, 1995

[30] Foreign Application Priority Data

Sep. 19, 1994 [DE] Germany ..... 44 33 258.0

[51] Int. Cl.[6] ..... F02D 13/04

[52] U.S. Cl. ..... 123/321

[58] Field of Search ..... 123/321, 320, 123/322, 324

[56] References Cited

U.S. PATENT DOCUMENTS

| | | | |
|---|---|---|---|
| 5,315,974 | 5/1994 | Sabelstrom et al. | 123/320 |
| 5,406,918 | 4/1995 | Joko et al. | 123/321 |
| 5,460,131 | 10/1995 | Usko | 123/321 |
| 5,462,025 | 10/1995 | Israel et al. | 123/321 |
| 5,485,819 | 1/1996 | Joko et al. | 123/321 |

FOREIGN PATENT DOCUMENTS

| | | | |
|---|---|---|---|
| 0608522 | 12/1991 | European Pat. Off. . | |
| 0459429 | 8/1994 | European Pat. Off. . | |
| 3904497 | 1/1990 | Germany | 123/321 |
| 4301835 | 11/1993 | Germany . | |

*Primary Examiner*—Raymond A. Nelli
*Attorney, Agent, or Firm*—Klaus J. Bach

[57] ABSTRACT

In a motorbrake arrangement for a Diesel engine which utilizes a high pressure fuel reservoir from which fuel is supplied to the injector of each of the various engine cylinders, and each of the cylinders includes a decompression valve which is hydraulically operated for decompression of gas compressed in the engine cylinder during the engine compression stroke, the decompression valve is operable by high pressure fuel admitted to the decompression valve through a control line from the high pressure fuel reservoir under the control of an electromagnetic valve arranged in the control line.

9 Claims, 3 Drawing Sheets

MOTORBRAKE FOR A DIESEL ENGINE

BACKGROUND OF THE INVENTION

The invention relates to a motorbrake for a Diesel engine with intake and exhaust valves and a high pressure fuel pump delivering fuel under pressure to a high pressure fuel supply line and a control line leading to an engine decompression valve for operating the decompression valve at the end of the engine compression stroke under the control of an electronic control device.

Motorbrake systems for commercial vehicle internal combustion engines which include a motorbrake valve in the engine exhaust pipe are well known. It is also well known that motorbraking performance can be further enhanced by fixed throttling structures serving as decompression valves which are continuously open during the motorbraking phase.

DE 39 04 497 C1 discloses a decompression brake comprising a hydraulic operating mechanism with a hydraulic cylinder and a hydraulic piston for controlling an exhaust valve of the internal combustion engine. The hydraulic operating mechanism and consequently, the exhaust valve, are actuated by the motor-driven injection pump by providing in the injection line leading to the injector a flow control device which interrupts the fuel supply from the injection pump to the injector and provides for communication with the hydraulic valve operating mechanism at the end of the compression stroke. The hydraulic valve operating mechanism then opens the exhaust valve slightly, whereby the air compressed during the compression stroke is discharged so that the energy transferred to the gas during the comprerssion stroke can not be returned to the engine during the following expansion stroke.

It is the object of the present invention to provide a motorbrake for a Diesel engine by which the braking performance can be adapted to the braking requirements and can be freely selected over the full engine rpm range.

SUMMARY OF THE INVENTION

In a motorbrake arrangement for a Diesel engine utilizing a high pressure fuel reservoir, fuel is supplied to the injectors of the various engine cylinders and is injected into the cylinders under the control of an electromagnetically operated valve. Each of the cylinders includes a decompression valve hydraulically operated for decompression of gas compressed in the engine cylinder during the engine compression stroke. The decompression valve is operable by high pressure fuel admitted to the decompression valve through a control line from the high pressure fuel reservoir under the control of an electromagnetic valve arranged in the control line and adapted to release the gas compressed in the engine cylinder during the compression stroke.

By utilizing a common high pressure fuel storage pipe (common rail) from which fuel under pressure is supplied to the magnetically controlled injectors also as the pressurized fluid source for operating a decompression valve, the braking performance of the engine can be easily controlled by controlling the opening and closing points of the decompression valve or by controlling the fuel pressure in the common rail. It is made sure that, during the braking operation, no fuel is injected into the engine. It is also possible to selectively activate the decompression valve of particular cylinders of the engine. By controlled actuation of the decompression valves, it is therefore possible to achieve optimal braking performance over the full engine rpm range.

The invention will be described in greater detail on the basis of the attached drawings.

DESCRIPTION OF PREFERRED EMBODIMENTS

Figure 1:
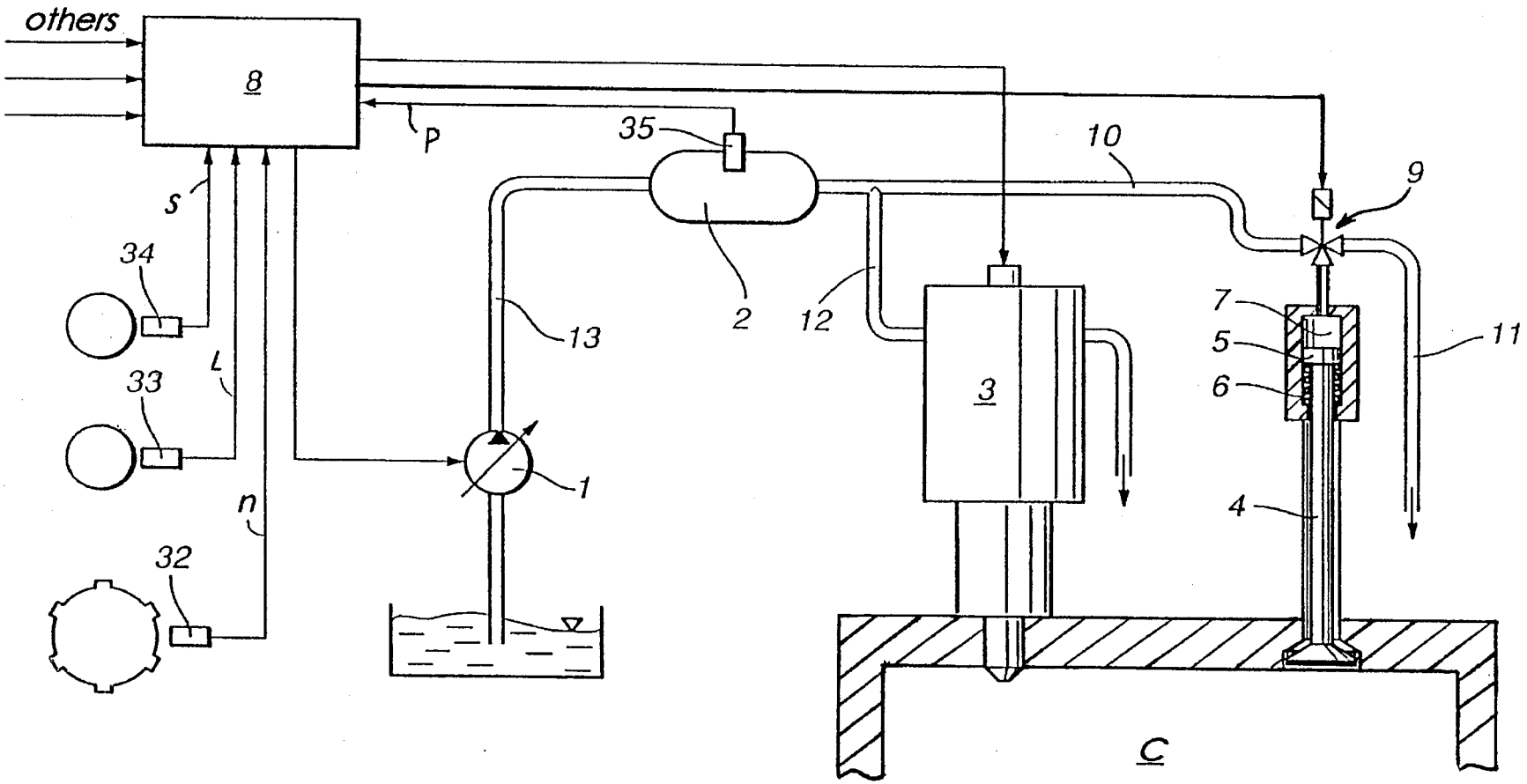
FIG. 1 shows a motorbrake system according to the invention with a separate decompression valve.

FIG. 1 shows a simple motorbraking system for a Diesel internal combustion engine wherein a high-pressure pump 1 constantly supplies fuel under high pressure in a controlled manner through a fuel supply line 13 to a high pressure fuel reservoir 2 which is a common supply pipe (common rail) for electromagnetic valve—controlled injectors 3.

Each engine cylinder C has, in addition to the intake and exhaust valves (not shown) controlling the gas flow through the cylinder, a decompression valve 4. The decompression valve is an additional exhaust valve which, at its rear end, is provided with an operating piston 5 and a return spring 6 biasing the decompression valve toward its closed position. The operating piston 5 delimits an operating cylinder space 7 which can be placed into communication with the common fuel supply pipe 2 by way of a control line 10 and a control valve 9, preferably a 3/2 way valve, operated by an electronic control unit 8.

The 3/2 way valve 9 controls the fuel flow from the common fuel supply line 2 to the operating cylinder space 7 of the decompression valve 4 or releases the fuel from the operating cylinder space 7 to a low pressure system via a low pressure conduit 11. The common fuel supply line 2 is connected to all the injectors 3 of at least one cylinder bank of the internal combustion engine by means of injection lines 12 and also with all the decompression valves 4 of this cylinder bank by means of control lines 10 branching off the injection lines 12. However, the control lines 10 may also be connected directly to the fuel supply pipe 2.

Figure 2:
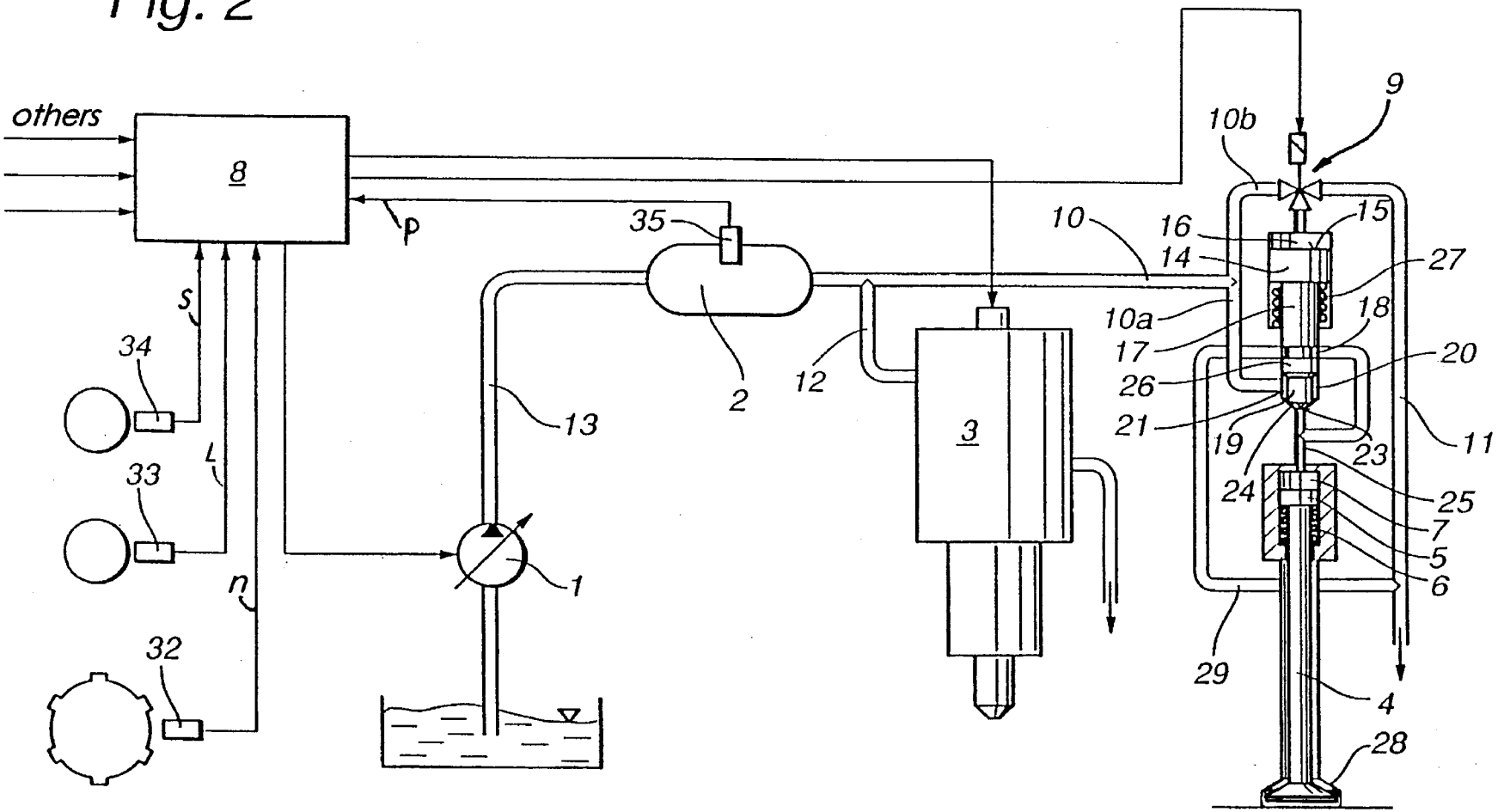
FIG. 2 shows a motorbrake system with an additional control piston which is operatively connected to the decompression valve.

FIG. 2 shows an embodiment which includes a control piston 14 disposed in a cylinder and associated with the decompression valve 4. The control piston 14 has a piston face 15 delimiting an upper pressure chamber 16 and can be placed in communication with the common fuel supply pipe 2 by means of the 3/2 way valve 9. The control piston 14 forms, adjacent the piston 14, a control spool valve with an annular control groove 18 extending around the spool 17. At the end of the spool opposite the piston 14, the spool diameter is reduced so that between the wall of the hydraulic cylinder 20 and the smaller diameter spool portion 19, an annular space 21 is formed to which one line section **10*a* of the forked control line 10 leads. The other line section 10*b* leads to the cylinder pressure chamber 16 and includes the 3/2 way control valve 9**.

The smaller diameter spool portion 19 has a cone-shaped seating surface 23 and is seated on a correspondingly shaped valve seat 24. In the embodiment as shown in FIG. 2, flow communication from the line section **10*a* via a connecting line 25 to the operating cylinder space 7 of the decompression valve 4 is interrupted as the cone shaped end of the spool valve is seated on the valve seat 24. The control piston 14 is held in its seated position by the pressurized fuel admitted to the pressure chamber 16 since the piston face area 15 is substantially larger than the shoulder area 26 delimiting the annular space 21 formed around the spool 17**.

If the pressure chamber 16 is depressurized by means of the 3/2 way valve 9 by establishing communication with the low pressure line 11, the control piston 14 is lifted by the fluid pressure in the annular space 21 aided by a compression spring 27 whereby pressurized fuel is admitted to the cylinder space 7 and the operating piston 5 of the decompression valve is moved by the pressurized fuel to lift the valve 4 off the valve seat 28, that is to open the decompression valve 4. This releases the compressed gas in the respective engine cylinder.

The return flow path for the fuel from the cylinder space 7 through the return flow line 29 which provides for communication between the connecting line 25 and the low pressure conduit 11. It extends through the annular control groove 18 on the spool 17 and is interrupted when the spool 17 is unseated.

As soon as the magnetic valve 9 switches over so that pressurized fuel is admitted to the pressure space 16 and the control piston 14 is moved to seat the spool whereby the fuel supply to the cylinder 7 is interrupted and the decompression valve 4 is closed, the fluid flow return path via the control groove 18 is opened. The pressurized fuel is then released from the operating space 7 and the decompression valve 4 is closed by the return spring 6.

The arrangement of FIG. 2 has an advantage over the arrangement of FIG. 1 insofar as the use of a control piston with a spool valve for the control of the fuel supply to the decompression valve requires the use of only a very small amount of fuel for operating the spool valve. Consequently, the magnetic control valve 9 can be quite small and reqires only a small control signal for activation.

Figure 3:
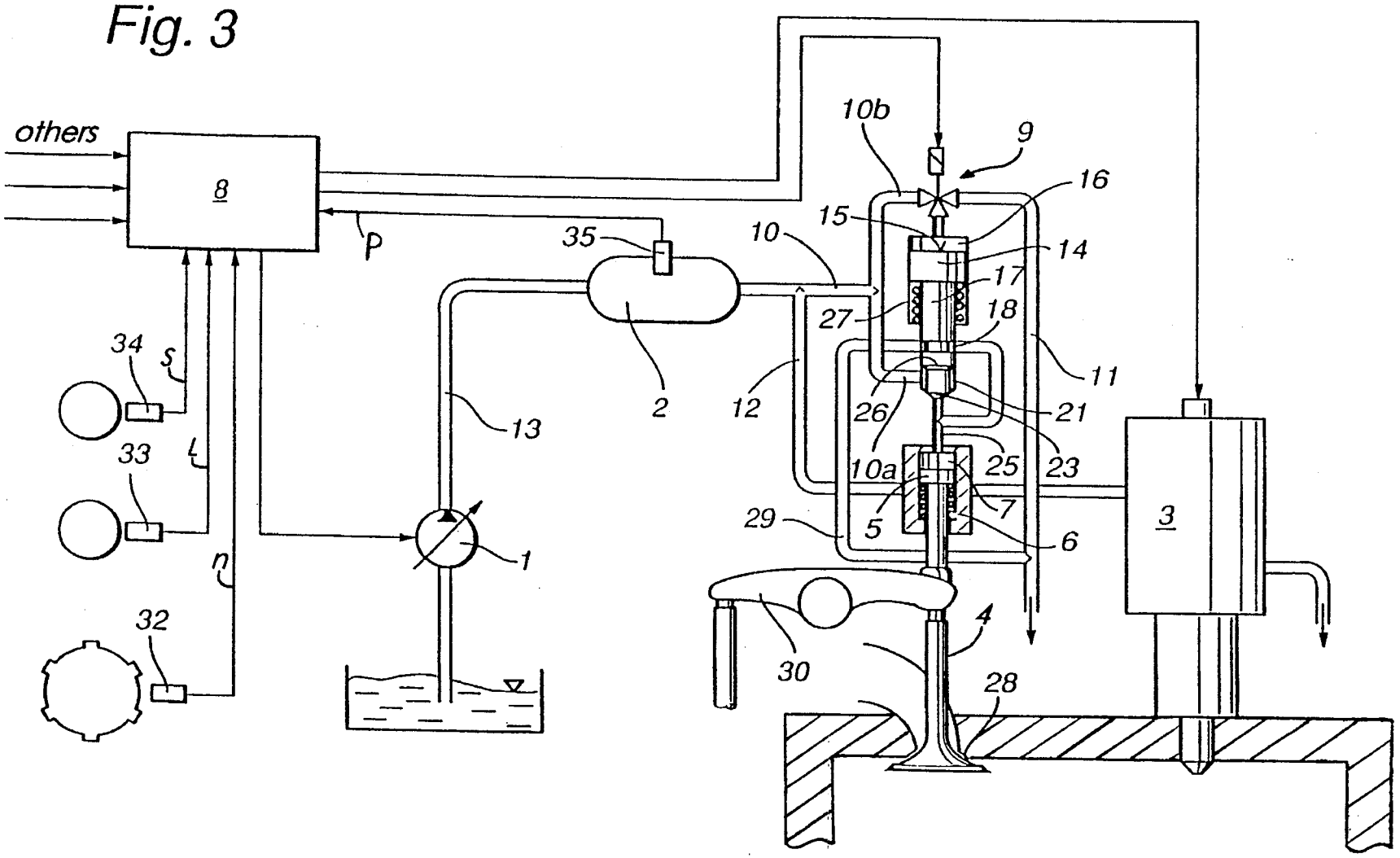
FIG. 3 shows an arrangement wherein the engine exhaust valve is utilized also as a decompression valve.

In the arrangement according to FIG. 3, the fuel line arrangements and connections correspond to those as shown in FIG. 2, but the engine exhaust valve serves, simultaneously, as the decompression valve 4.

The exhaust valve is operated, as usual, purely mechanically by way of a cam-activated rocker arm 30. The rocker arm 30 engages the valve shaft for operating the exhaust valve, but is uncoupled from the valve shaft when the exhaust valve is used as a decompression valve. This means that the rocker arm 30 moving with the valve assumes a valve operating position wherein the cam operated push rod 31 would not engage the rocker arm when the exhaust valve is opened for decompression.

The rapidly switching 3/2 way valve 9 is controlled by the electronic control unit 8 which processes input signals such as engine rpm n, load L, synchronization S, pressure P in the common fuel supply line 2 and other signals to form a control signal for the control of the electromagnetic operating mechanism for the decompression valve 4. The respecrive sensors are indicated by the numerals 32 (speed sensor), 33 (load sensor), 34 (synchronization sensor), and 35 (pressure sensor).

The braking performance can be controlled by controlling the pressure of the fuel in the fuel pressure reservoir 2 (common rail), by controlling the opening and closing points of the decompression valve 4 or by selective activation of the decompression valves of the various cylinders of the engine.

What is claimed is:

1. A motorbrake for a Diesel internal combustion engine having at least one cylinder and for each cylinder air inlet and exhaust valves, a high pressure fuel pump for providing pressurized fuel, a high pressure fuel reservoir (common rail) in communication with said high pressure fuel pump for receiving the pressurized fuel therefrom, an injector mounted on each cylinder and having an injection line in communication with said high pressure fuel reservoir for supplying high pressure fuel to said injector, a decompression valve mounted on said cylinder for decompression of gas compressed in said cylinder during the engine compression stroke, said decompression valve being operable by high pressure fuel by way of a control line providing for communication between said high pressure fuel reservoir and said decompression valve, a control valve arranged in said control line for controlling admission of fuel to, and its release from, said decompression valve and a control unit for operating said control valve to activate said decompression valve at the end of the engine compression stroke.

2. A motorbrake according to claim 1, wherein said decompression valve includes an operating piston movably disposed in a hydraulic cylinder and said control valve is a 3/2 way valve providing for communication of said hydraulic operating cylinder selectively either with said high pressure fuel reservoir for admitting high pressure fuel to said hydraulic cylinder or with a low pressure fuel system for discharging fuel from said hydraulic cylinder.

3. A motorbrake according to claim 2, wherein, downstream of said control valve, said control line is connected directly to said hydraulic operating cylinder.

4. A motorbrake according to claim 1, wherein said control line is forked forming a first-line section containing a 3/2 way valve and leading to a control cylinder with a control piston connected to a spool valve and a second line section leading to an annular space which is formed around said valve spool and which can be placed in communication with said decompression valve by actuation of said spool valve.

5. A motorbrake according to claim 4, wherein said annular space around said spool valve is formed by a reduced cross-section of said spool valve at its end opposite said control piston and the end of said spool is cone-shaped and adapted to close a connecting line leading from said spool valve to said decompression valve for controlling admission of pressurized fuel to said decompression valve, and wherein a fuel return line extends from said connecting line to a low pressure fuel system via a control groove formed in said spool valve which opens said fuel return line when the fuel supply to said connecting line is blocked.

6. A motorbrake according to claim 5, wherein said control piston is spring loaded so that the cone shaped end of said spool is unseated when fuel pressure is released from said control cylinder whereby high pressure fuel from said high pressure fuel storage is admitted through said connecting line to said decompression valve for operating said decompression valve and, at the same time, blocks the fuel return flow through said control groove is blocked.

7. A motorbrake according to claim 1, wherein said decompression valve is arranged spatially separated from the engine exhaust valve.

8. A motorbrake according to claim 1, wherein said engine exhaust valve serves also as said decompression valve and has a mechanical drive mechanism which can be uncoupled from said exhaust valve and the exhaust valve is operated for decompression of the gas at the end of the engine compression stroke.

9. A motorbrake according to claim 8, wherein said engine exhaust valve has a stem engageable by a rocker arm which is mechanically operated by a push rod to open the exhaust valve during the engine exhaust stroke and from which said exhaust valve stem is disengageable for activation of the exhaust valve for decompression of the gases compressed in the engine at the end of the engine compression stroke.

* * * * *